US011280576B2

(12) United States Patent
Williams

(10) Patent No.: US 11,280,576 B2
(45) Date of Patent: Mar. 22, 2022

(54) RIFLED BARREL

(71) Applicant: David Alan Williams, Bluffton, IN (US)

(72) Inventor: David Alan Williams, Bluffton, IN (US)

( * ) Notice: Subject to any disclaimer, the term of this patent is extended or adjusted under 35 U.S.C. 154(b) by 0 days.

(21) Appl. No.: 16/700,550

(22) Filed: Dec. 2, 2019

(65) Prior Publication Data

US 2020/0173754 A1 Jun. 4, 2020

Related U.S. Application Data

(60) Provisional application No. 62/773,500, filed on Nov. 30, 2018.

(51) Int. Cl.
*F41B 11/70* (2013.01)
*F42B 6/10* (2006.01)

(52) U.S. Cl.
CPC ..... *F41B 11/70* (2013.01); *F42B 6/10* (2013.01)

(58) Field of Classification Search
CPC .. F41B 11/70; F41B 6/10; F41B 10/00; F41B 10/02; F41B 10/04; F41B 10/06; F41B 10/26; F41B 12/40; F41B 12/46
USPC ..... 124/56
See application file for complete search history.

(56) References Cited

U.S. PATENT DOCUMENTS 3,791,303 A * 2/1974 Sweeney ..... F42B 30/04 102/502
4,030,421 A * 6/1977 Litman ..... F41A 21/46 102/515
4,735,148 A * 4/1988 Holtzman ..... F42B 14/064 102/522
5,228,427 A * 7/1993 Gardner, Jr. ..... F41A 21/28 124/71
5,936,190 A * 8/1999 Buzick ..... F42B 12/40 102/502
6,145,441 A * 11/2000 Woodall ..... F42B 8/14 102/370
6,230,630 B1 * 5/2001 Gibson ..... F42B 10/24 102/477
6,615,739 B2 * 9/2003 Gibson ..... F42B 10/24 102/311
7,143,699 B2 * 12/2006 Brock ..... F42B 8/14 102/502
7,526,998 B2 * 5/2009 Vasel ..... F42B 7/08 102/370
8,770,179 B2 * 7/2014 Haynes ..... F41B 11/80 124/56
8,875,634 B2 * 11/2014 Gibson ..... F42B 10/06 102/502
9,228,814 B2 * 1/2016 Macy ..... F41A 9/65
D765,215 S * 8/2016 Gibson ..... D22/115
9,574,844 B2 * 2/2017 Williams ..... F41B 11/62
9,574,845 B1 * 2/2017 Wyne ..... F41B 11/62
9,587,903 B2 * 3/2017 Sullivan ..... F41A 19/12
9,746,297 B2 * 8/2017 Buys ..... F42B 12/745
9,766,049 B2 * 9/2017 Gibson ..... F42B 10/26
9,952,016 B2 * 4/2018 Sullivan ..... F41B 11/55
D822,145 S * 7/2018 Gibson ..... D22/115
(Continued)

*Primary Examiner* — Joshua E Freeman
(74) *Attorney, Agent, or Firm* — Indiana University Maurer School of Law Intellectual Property Legal Clinic

(57) ABSTRACT

A rifled barrel having splines. A projectile has at least one inner fin. A method to spin a projectile to render its shell and its fluid to spin at the approximately the same rate.

19 Claims, 7 Drawing Sheets

(56) References Cited

U.S. PATENT DOCUMENTS 10,295,319 B2 * 5/2019 Gibson ..... F42B 12/40
10,436,560 B2 * 10/2019 Carlson ..... F42B 5/145
2005/0016412 A1 * 1/2005 Vasel ..... F42B 7/10 102/502
2006/0191525 A1 * 8/2006 Dai ..... F41B 11/62 124/83
2006/0254453 A1 * 11/2006 Leal ..... F42B 12/40 102/513
2006/0288898 A1 * 12/2006 Byun ..... F42B 12/40 102/502
2009/0007895 A1 * 1/2009 Kenworthy ..... F41B 1/00 124/62
2009/0013892 A1 * 1/2009 Judson ..... F42B 12/76 102/502
2009/0307954 A1 * 12/2009 Wang ..... F41G 11/003 42/90
2012/0192845 A1 * 8/2012 Bok ..... F41B 11/62 124/73
2012/0199034 A1 * 8/2012 Gibson ..... F42B 12/40 102/502
2013/0213376 A1 * 8/2013 Kenworthy ..... F42B 6/003 124/62
2013/0217025 A1 * 8/2013 Gibson ..... B01J 19/0046 435/6.12
2014/0338649 A1 * 11/2014 Williams ..... F41B 11/55 124/73
2015/0144018 A1 * 5/2015 Buys ..... F42B 12/40 102/502
2015/0226519 A1 * 8/2015 Hsu ..... F42B 10/26 124/82
2016/0076850 A1 * 3/2016 Sullivan ..... F41B 11/723 124/63
2016/0216089 A1 * 7/2016 Gibson ..... F42B 12/40
2016/0273871 A1 * 9/2016 Williams ..... F41A 9/68
2017/0176131 A1 * 6/2017 Sullivan ..... F41B 11/52
2017/0176133 A1 * 6/2017 Sullivan ..... F41B 11/55
2020/0056864 A1 * 2/2020 Dwire ..... F42B 6/10
2020/0173754 A1 * 6/2020 Williams ..... F42B 6/10

* cited by examiner

RIFLED BARREL

RELATED APPLICATION

This application claim priority to U.S. patent provisional application, application numbered 62/773,500, filed Nov. 30, 2018, by David Alan Williams, and titled "RIFLED BARREL." The disclosure of the whole provisional application is hereby incorporated by reference.

FIELD OF THE DISCLOSURE

This disclosure relates to a rifled barrel

BACKGROUND OF THE DISCLOSURE

A gun barrel may be rifled to create rotation of the projectile being shot from a gun. Some gun barrels are rifled by providing spiral grooves in the gun barrel. According to the present disclosure, a gun barrel is rifled by providing spiral splines in the gun barrel. The traditional projectiles, like the projectiles of U.S. Patent Publication No. US20120199034A1, can be improved.

SUMMARY OF THE DISCLOSURE

The present disclosure includes a rifled bore. In one embodiment, the rifled bore includes a gun barrel and a plurality of splines.

Figure 1:
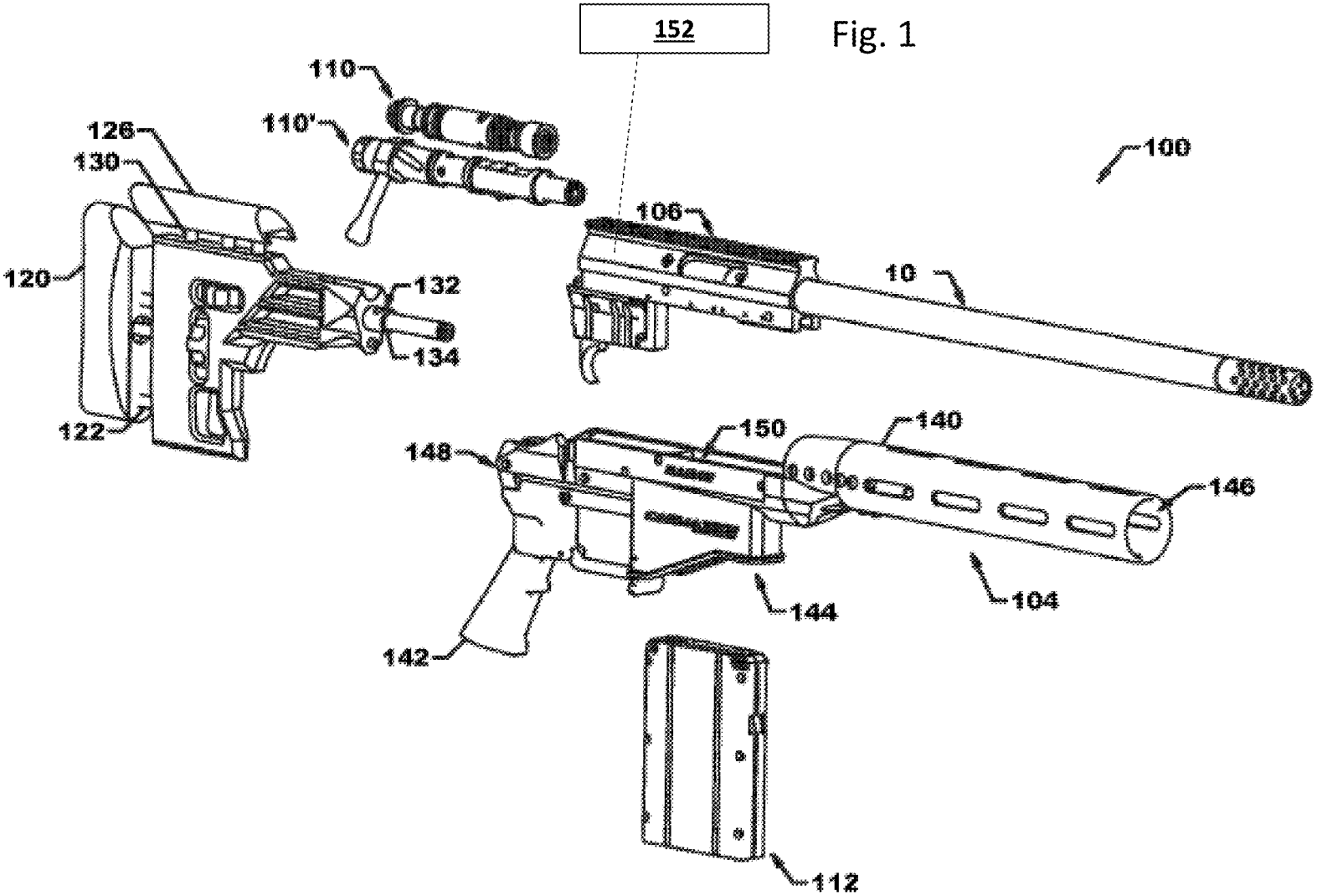
FIG. 1 is an exploded perspective view of a paintball marker having a gun barrel.
Figures 2A, 2B:
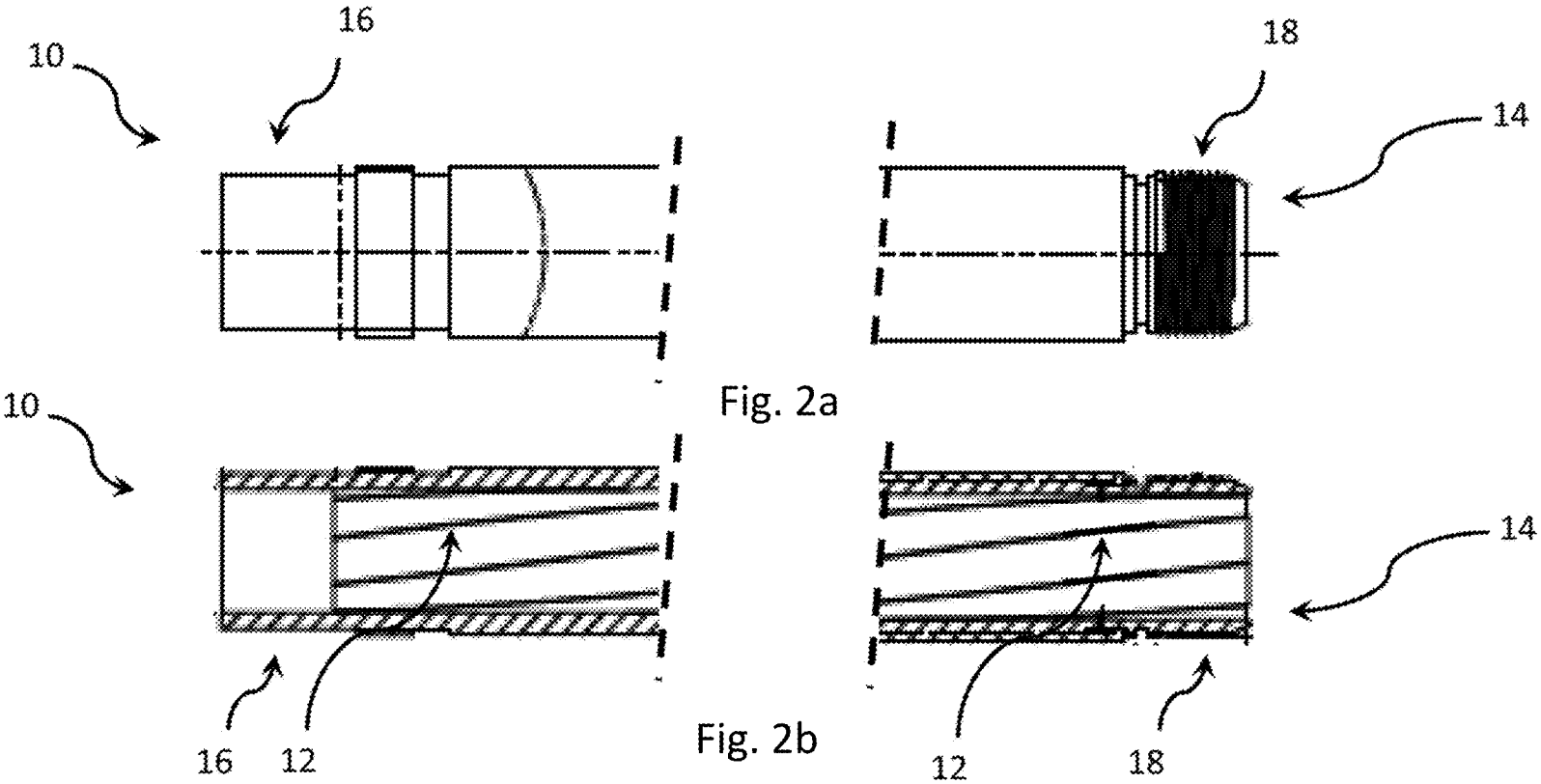
FIG. 2*a* is a slide elevation view of the gun barrel with a middle section broken away.
FIG. 2*b* is a cross-selection view of the gun barrel of FIG. 1 taken across the length of the gun barrel showing a plurality of spiral splines in the gun barrel.
Figure 3:
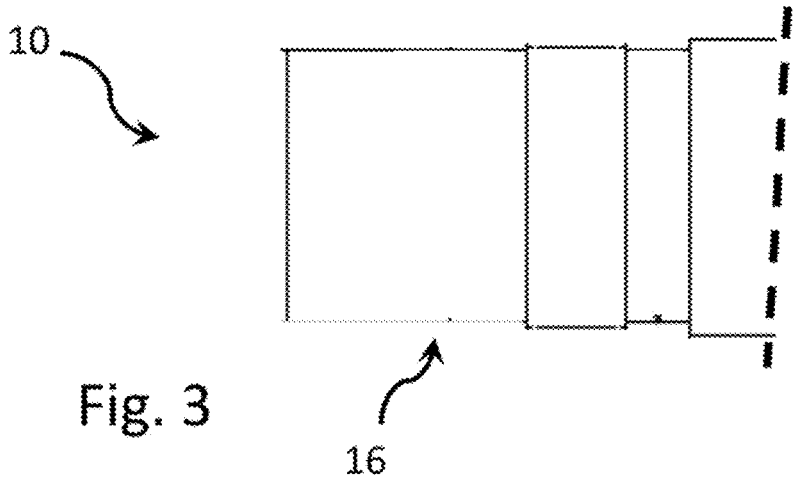
FIG. 3 is an enlarged view of a portion of the gun barrel of FIG. 1.

For the purposes of promoting an understanding of the principals of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. It will be understood that no limitation of the scope of the disclosure is thereby intended. The disclosure includes any alterations and further modifications in the illustrative devices and further applications of the principles of the disclosure which would normally occur to one skilled in the art to which the disclosure relates. Unless otherwise indicated, the components in the drawings are shown proportional to each other.

DETAILED DESCRIPTION OF THE DRAWINGS

As depicted in FIG. 1, paintball marker 100 includes a stock portion, a frame or chassis 104, a receiver 106, a barrel 10, a firing valve 110, 110', and a magazine 112. The stock portion includes a stock frame shoulder abutment 120, a shoulder abutment adjuster 122, a facial abutment 126, and a facial abutment extension rods 130. The stock frame includes an attachment element 132 having an insert adapter 134 which is adapted to cooperate with stock receiving portion 148 of frame 104 to secure the stock portion with frame 104. Frame 104 is depicted including a frame body 140 and a handle 142. Frame body 140 defines a magazine receiving portion 144, a barrel receiving portion 146, a stock receiving portion 148, and a receiver receiving portion 150. Additional details of suitable paintball marker 100 are described in U.S. Pat. No. 9,574,844, to David A. Williams, titled "Paintball Marker with Interchangeable Firing Modes," the entire disclosure of which is expressly incorporated by reference herein.

As shown in FIGS. 2*b* and 4-7, gun barrel 10 includes a plurality of spiral splines 12 extending between a first end 14 of gun barrel 10 and a second end 16 of gun barrel 10. First end 14 includes a plurality of external threads 18 to facilitate attachment of gun barrel 10 to receiver 106.

According to the preferred embodiment of the present disclosure, gun barrel 10 is used to guide paintball projectiles 30 such as those described herein during firing of a paintball marker. Details of another suitable paintball projectile are provided in U.S. Pat. No. 8,875,634, to Gibson et al., titled "Aerodynamic Projectile," the entire disclosure of which is expressly incorporated by reference herein. According to alternative embodiments, projectiles other than paintball projectiles may be fired from barrel 12, such as shotgun projectiles or other projectiles used in firearms, less than lethal, riot control, and border control applications. According to the preferred embodiment of the present disclosure, projectiles 30 are propelled with air suing a pressurized pneumatic system 152. Therefore, projectiles are devoid of a propellant, such as gunpowder.

Figure 4:
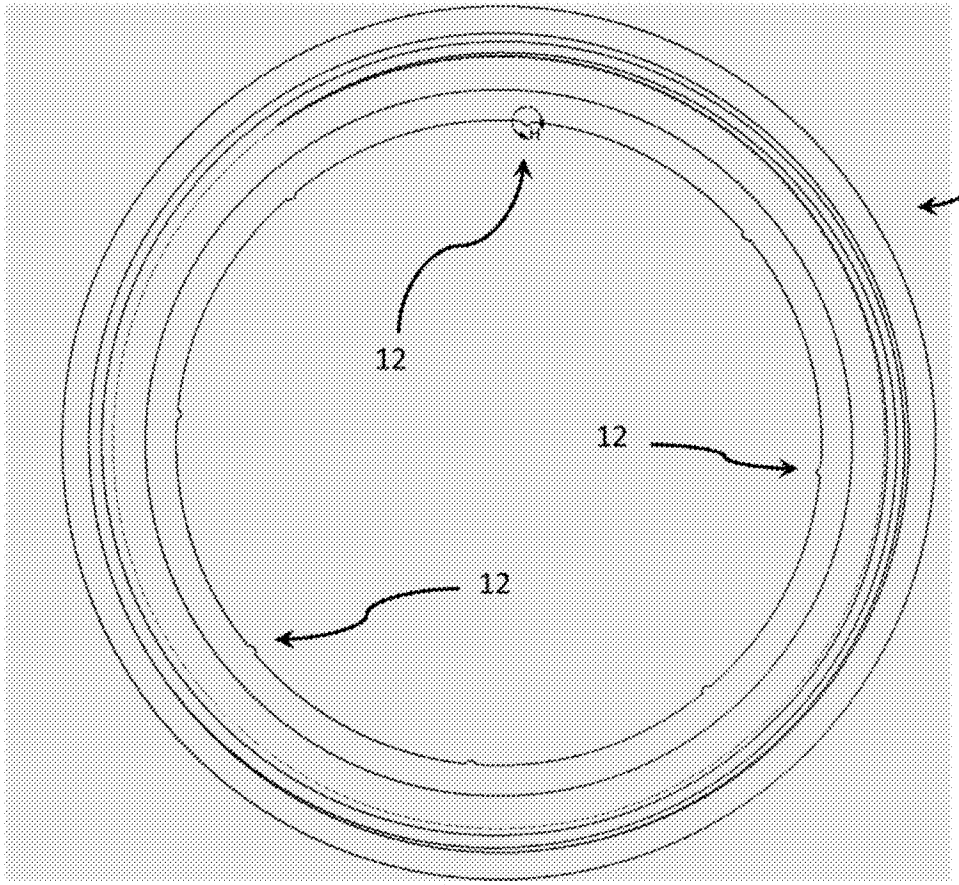
FIG. 4 is a cross-sectional view of the gun barrel of FIG. 1 taken across the width of the gun barrel showing eight splines.
Figure 5:
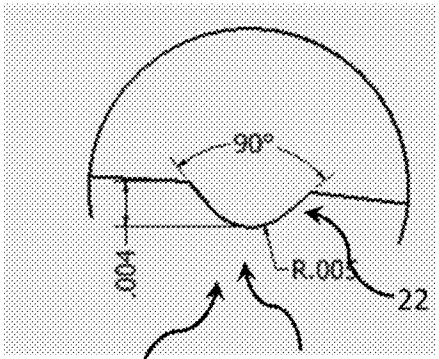
FIG. 5 is an enlarged view of a portion of FIG. 4 showing one of the splines.
Figure 7:
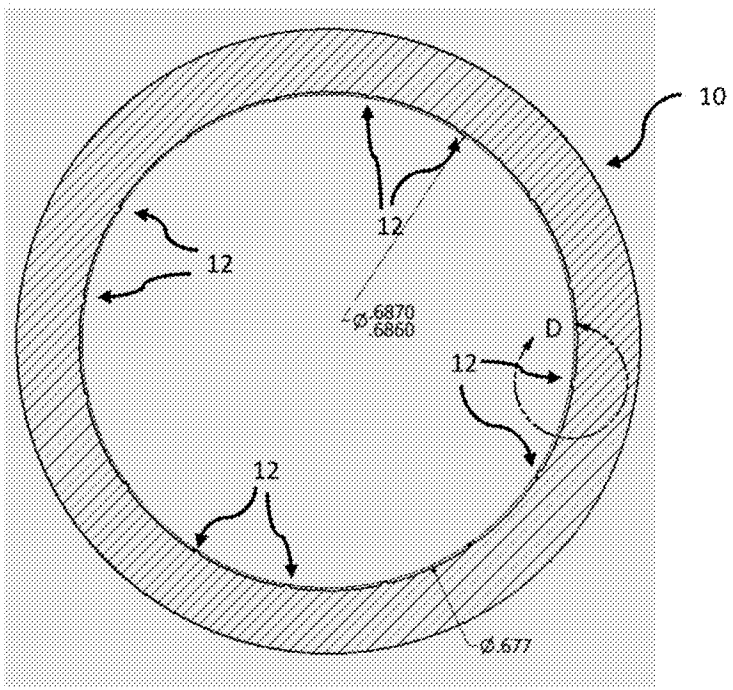
FIG. 7 is a cross-sectional view of a gun barrel of FIG. 1 taken across the width of the gun barrel showing sixteen splines.
Figure 6:
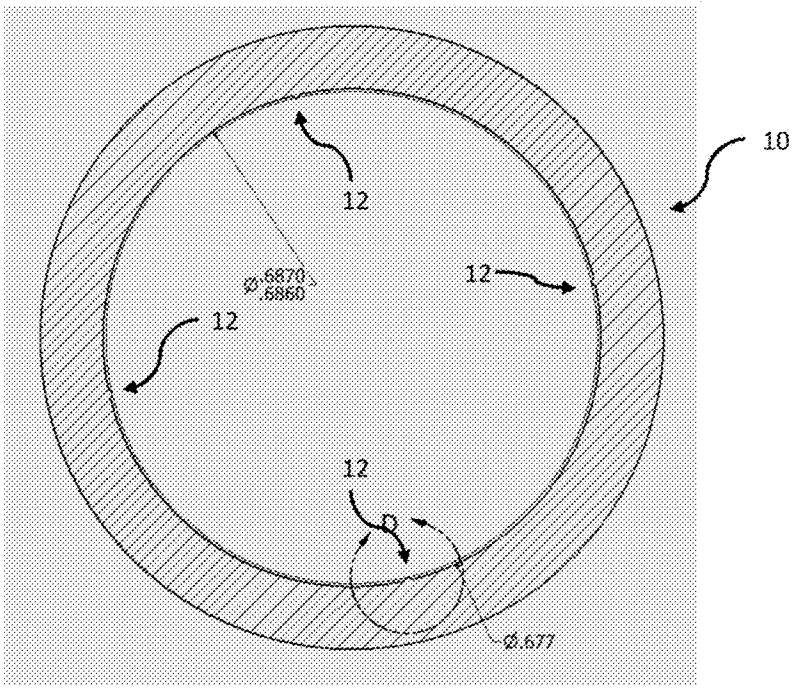
FIG. 6 is a cross-sectional view of a gun barrel similar to that shown in FIG. 1 taken across the width of the gun barrel showing four splines.

As shown in FIG. 4, gun barrel 10 may have eight spiral splines 12. Gun barrel 10 has a length of about 20 inches, outside diameter of about 0.927 inches, inside diameter of about 0.685 inches, and a total interior circumference of about 2.158 inches. Referring to FIG. 5, each spline 12 has a height of about 0.004 inches and a tip 20 having a radius of about 0.005 inches. According to other embodiments, gun barrel 10 may include fewer or more splines 12, such as three, four (as shown in FIG. 6), five, six, ten, twelve, sixteen (as shown in FIG. 7), twenty, thirty, etc. splines 12.

Still referring to FIG. 5, sides 22 of spline 12 define an angle therebetween of about 90 degrees. Splines 12 are roughly the shape of an equilateral triangle with tip 20 being rounded. According to other embodiments, splines could be other shapes, such as square, half-circle, etc. Splines 12 preferably make one rotation every 18.75 inches in barrel 10. Other than splines 12, the bore of gun barrel 10 is substantially smooth. According to one embodiment of the present disclosure, 6", 8", and 10" long barrels are provided with a 1:18.75 twist ratio (i.e. 1 twist of ribs 12 over 18.75" of linear travel). According to another embodiment of the present disclosure, 12", 14" and 16" long barrels are provided with a 1:33 twist ratio (i.e. 1 twist of ribs 12 over 32" of liner travel). According to yet another embodiment, a 20" and 22" long barrels are provided with a 1:48 twist ratio (i.e. 1 twist of ribs 12 over 48" of linear travel). In each of these embodiments, less than one full twist of ribs 12 is provided in barrel 10. The 6", 8", and 10" long barrels 10 have 0.32, 0.43, and 0.53 twists of ribs 12, respectively. The 12", 14", and 16" long barrels have 0.36, 0.42, and 0.48 twists of ribs 12, respectively. The 20" and 22" long barrels 10 have 0.42 and 0.46 twists of ribs. 12. According to other embodiments, barrels may have 0.2, 0.3, 0.4, 0.5, 0.6, 0.7 twists of ribs 12.

Returning to FIG. 4, splines 12 occupy a relatively small portion of the inside surface area of the bore. When viewed in cross-section, the eight splines 12 of gun barrel 10 of FIG. 4 comprise a total of approximately 0.09 inches of the circumference and 0.11 inches of the contour, allowing for approximately 2.068 inches of exposed smooth bore, and yielding about 96% smooth bore surface area/counter to about 4% rib surface area. Further, referring to FIG. 6, the four splines 12 of gun barrel 10 of FIG. 6 comprise a total of approximately 0.045 inches of the circumference and 0.055 inches of contour, allowing for approximately 2.113 inches of exposed smooth bore, and yielding about 98% smooth bore surface area/contour to about 2% rifling surface. Further referring to FIG. 7, the sixteen splines 12 of gun barrel 10 of FIG. 7 comprise a total of approximately 0.18 inches, allowing for approximately 1.978 inches of exposed smooth bore, and yielding 90-91.6% smooth bore surface/contour to about 8.4-10% rifling surface/contour. According to other embodiments, splines occupy other percentages of the internal circumference or surface of the rifled bore, such as 0.1%, 0.2%, 0.3%, 0.5%, 0.75%, 1.0%, 1.5%, 1.75%, 3.5%, 3%, 3.5%, 4%, 7.5%, 15%, etc.

Figure 8A:
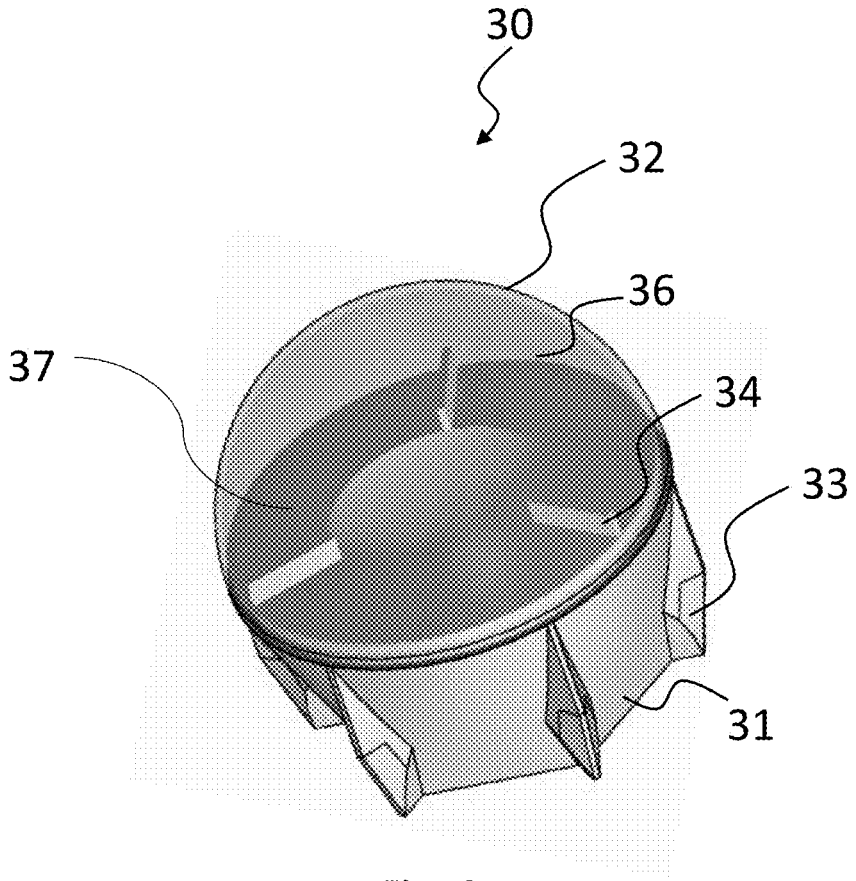
FIG. 8*a* shows a perspective view of a projectile.
Figure 8B:
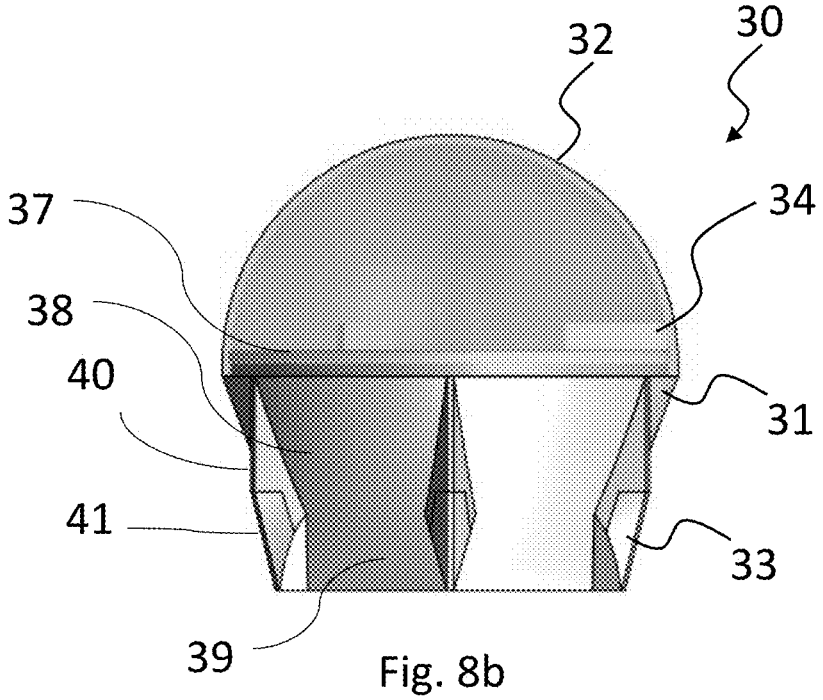
FIG. 8*b* shows a side view of the projectile of FIG. 8*a;*
Figure 8C:
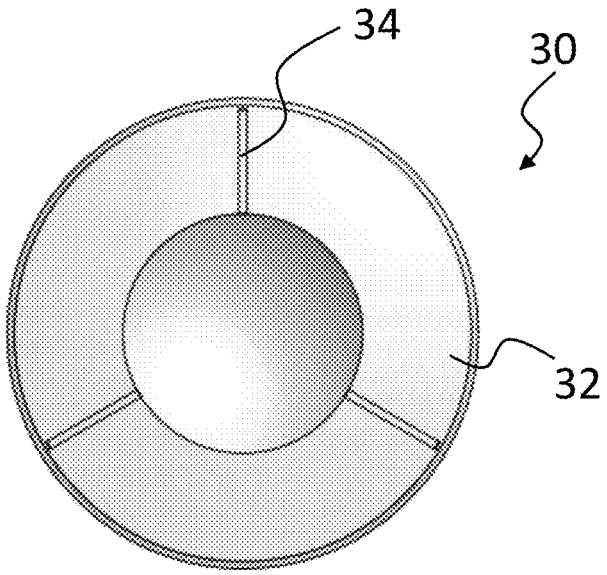
FIG. 8*c* shows a top view of the torn-down projectile of FIG. 8*a*.
Figure 8D:
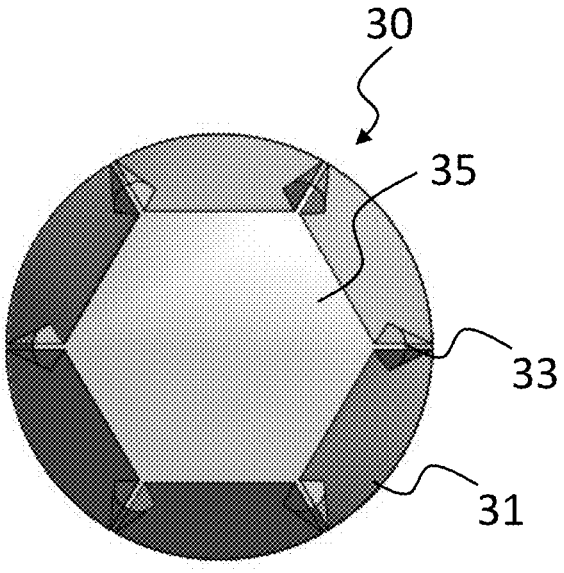
FIG. 8*d* shows a bottom view of the projectile of FIG. 8*a*.

Projectile 30 shown in FIG. 8*a* has a shell including a first shell 31 and a second shell 32 enclosing fluid 36, such as paint, assembled together. Inner fins 34 protrudes into an inner space 36 of projectile 30, inner fins 34 are positioned adjacent to first shell 31. The location, number, and shape of inner fins 34 is not limited by the example shown in FIGS. 8*a-d*. Projectile 30 further includes outer fins 33 disposed on the outer surface of first shell 31. Outer fins 33 have a first edge 40 that is substantially parallel to a longitudinal axis of projectile 30 and a second portion 41 that tapers inward toward the longitudinal axis.

First shell 31 has a substantial flat bottom wall 35, optionally in a hexagon shape, a substantially flat top wall 37, a conical first side wall 38, and second side wall 39 that transitions from being cylindrical near first wall 38 to hexagonal near flat bottom 35. Preferably, bottom wall 35, top wall 37, first side wall 38, and second side wall 39 are 0.012 inches thick and cooperative to define a closed hollow interior space that is devoid of fluid and preferable filled with air. The wall thickness of the shell of may be other thicknesses, such as approximately 0.01, 0.02, 0.03, or 0.04 inches. Conical first wall 36 tapers inward at about 16 degrees relative to the longitudinal axis of projectile 30. According to alternative embodiments, conical first wall 36 tapers inward at other angles relative to the longitudinal axis of projectile 30, such as 6, 8, 10, 12, 14, 16, 18, and 20 degrees.

First shell 31 and second shell 32 can be made of different kinds of material. Second shell 32 can be made of plastic, such as polystyrene, and first shell can also be made of plastic, such as polystyrene. Second shell 32 can be more flexible than the first shell 31.

During firing of a projectile 30, splines 12 cut into the outer, preferably plastic, shell of projectile providing grooves therein that match splines 12. As projectile 30 continues to travel down barrel 10, the cut grooves follow splines 12 and rotate projectile 30 along splines 12. As a result, when projectiles 30 leave barrel 10, they have an angular rotation. When fired, splines 12 cause the shell of projectile 30 to spin. Fluid 36 in projectile 30 is eventually caused to spin at approximately the same rate as that of the shell of projectile 30 as discussed below. The difference between the rotational rates of the shell and the fluid is between 30%, 20%, 15%, 10%, or 5%.

When initially accelerated, second shell 32 begins to rotate because of splines 12, but fluid 36 lags. As a result, fluid 36 rotates at a substantially different rate than second shell 32. Inner fins 34 push against fluid 36 increasing its rate of rotation so that its relative rate of rotation compared to the rate of rotation of second shell 32 decreases to the rates of rotation discussed herein.

The disclosure is not restricted exclusive to embodiments shown in FIGS. 1-8*d*, but may be varied freely within the scope of the claims. The present disclosure may be embodied in other specific forms, and accordingly, reference should be made to the appended claims, rather than to the foregoing specification, as indicating the scope of the disclosure. Modifications and variations of the present invention are possible in light of the above teachings. It is, therefore, to be understood that within the scope of the appended claims, the disclosure may be practiced otherwise than as specifically described in embodiments.

I claim:

1. A paintball marker including a gun stock, a gun barrel, and a pneumatic system for propelling a projectile through the gun barrel, the gun barrel having body defining a bore to receive projectiles and a plurality of rotating splines positioned in the bore to rotate projectiles travelling through the bore, the plurality of splines cutting into an outer shell of projectiles moving through the bore.

2. The paintball marker of claim 1, wherein the plurality of splines comprises at least two splines.

3. The paintball marker of claim 2, wherein the plurality of splines comprises at least four splines.

4. The paintball marker of claim 3, wherein the plurality of splines comprises at least eight splines.

5. The paintball marker of claim 1, wherein the plurality of splines have a tip having a radius of 0.005 inches.

6. The paintball marker of claim 1, wherein the plurality of splines have a height of 0.004 inches.

7. The paintball marker of claim 1, the plurality of splines include a pair of sides that define an angle therebetween of about 90 degrees.

8. The paintball marker of claim 1, further comprising a projectile including a plastic shell positioned in the bore and including an interior region including paint.

9. The paintball marker of claim 8, wherein the plurality of splines rotate the plastic shell of the projectile and the paint rotates at about the same rate as the plastic shell as the projectile leaves the gun barrel.

10. The paintball marker of claim 1, wherein the twist rate of the plurality of splines is about one revolution per 18 to 48 inches of a length of travel of the gun barrel.

11. The rifled bore of claim 1, the plurality of splines have about 0.3 to 0.6 twists in the bore.

12. A method of firing a projectile having a shell enclosing fluid therein, comprising:

providing a projectile having a shell and a fluid positioned in the shell;

firing the projectile with a rifled barrel of a paintball marker; and rotating the shell of the projectile and the fluid of the projectile at about the same rate by using fins inside the projectile to spin the fluid.

13. The method of claim 12, wherein the step of rotating the shell of the projectile and the fluid of the projectile at approximately the same rate including rotating the shell and the fluid of the projectile by the plurality of splines.

14. The method of claim 12, wherein the fluid rotates within about 30% of the rate of rotation of the shell.

15. The method of claim 14, wherein the fluid rotates within about 15% of the rate of rotation of the shell.

16. The method of claim 15, wherein the fluid rotates within about 5% of the rate of rotation of the shell.

17. A marker projectile, comprising:

a shell having a front end having a front hemispherical surface, a rear end positioned rearward of the front end, and a second surface positioned rearward of the front hemispherical surface, the front hemispherical surface and the second surface cooperating to define an interior space of the shell, the front end having an exterior profile and the rear end having an exterior profile that is substantially different in shape to the front end;

a fluid positioned in the interior space of the shell; and at least one fin extending from the second surface into the fluid.

18. The marker projectile of claim 17, wherein the first profile is generally hemispherical.

19. The marker projectile of claim 17, wherein an at least one fin protrudes from a surface of the second profile.

* * * * *